US005409146A

United States Patent [19]

Hazard et al.

[11] Patent Number: 5,409,146

[45] Date of Patent: Apr. 25, 1995

[54] DISPENSING PUMP WITH POSITIVE SHUT-OFF

[76] Inventors: Robert E. Hazard, 511 Fletcher Rd., North Kingstown, R.I. 02852-1612; Frederick R. Handren, 2111 Jefferson Davis Hwy., Suite 409-S, Arlington, Va. 22202

[21] Appl. No.: 70,768

[22] Filed: Jun. 3, 1993

[51] Int. Cl.[6] ..... B65D 88/54

[52] U.S. Cl. ..... 222/321.8; 222/384; 222/375; 417/566; 137/843

[58] Field of Search ..... 222/321, 383, 385, 384, 222/375; 417/566, 571; 92/23; 137/843, 847, 852, 860

[56] References Cited

U.S. PATENT DOCUMENTS

| | | | |
|---|---|---|---|
| 3,406,909 | 10/1968 | Pfeiffer | 239/333 |
| 3,527,551 | 9/1970 | Kutik et al. | 222/384 X |
| 3,966,095 | 6/1976 | Chappell | 222/384 |
| 4,410,107 | 10/1983 | Corsette | 222/321 |

*Primary Examiner*—Gregory L. Huson

[57] ABSTRACT

A container-mounted dispensing pump incorporates elastomeric duckbill valves for controlling the flow into and from the pump chamber. A mechanism within the pump employs hinged leaves which cooperate with the pump plunger to effect a pinching and closing one of the duckbill valves when the plunger is disposed in a depressed, shipping position. With the pump plunger held in the shipping position, the closed duckbill valve will preclude leakage of the container contents through the pump.

21 Claims, 6 Drawing Sheets

DISPENSING PUMP WITH POSITIVE SHUT-OFF

BACKGROUND OF THE INVENTION

1. Field of the Invention

The present invention is directed to a manually operated dispensing pump and more particularly to a finger-operated pump adapted for mounting on a container of liquid to be dispensed.

2. Brief Description of Background Art

Container-mounted, finger-operated dispensing pumps are well known and are used for dispensing liquids having widely varying flow characteristics. The form of discharge from these pumps can vary from a fine spray to a slow moving flow.

Typically, container-mounted dispensing pumps employ fixed and movable pump members forming a variable volume pump chamber and one-way valves controlling the flow into and out of the pump chamber. Various types of one-way valves, including ball check valves and elastomeric valves, are employed in these dispensing pumps.

A dispensing pump disclosed in U.S. Pat. No. 3,406,909 issued to Pfeiffer employs elastomeric one-way valves, known as "duckbill" valves, for controlling flow into and from the pump chamber. These valves operate reliably and are relatively inexpensive. Their one-piece construction simplifies the assembly of a dispensing pump in which they are employed.

Many dispensing pumps incorporate a feature which allows them to be placed in a "shipping" position to prevent leakage through the pump if they are upended. A common pump of this type employs a reciprocable plunger which can be locked in a depressed position to seal the pump against leakage. Applicants are not aware of dispensing pumps employing duckbill pump valves which can be placed in a shipping position to prevent leakage through the pump.

OBJECTS OF THE INVENTION AND SUMMARY

An object of the present invention is to provide a dispensing pump which operates reliably and which is inexpensive to manufacture.

Another object of the present invention is to provide a dispensing pump employing elastomeric duckbill pump valves.

Yet another object of the present inventions to provide a container-mounted dispensing pump incorporating a positive closing mechanism for a duckbill pump valve which precludes leakage of the container contents through the pump.

The foregoing objects of the invention, and others as well, are realized in the dispensing pump of the present invention which incorporates movable and stationary pump members forming a variable volume pump chamber, at least one elastomeric duckbill valve controlling the flow of liquid into or from the pump chamber and movable pinching elements for applying a positive closing force to a duckbill valve to prevent leakage through the pump. In disclosed embodiments of the present invention, the pinching elements are hinged and cooperate with the movable pump member to apply a positive closing force to the tip of a duckbill valve when the movable pump member is disposed in a depressed, shipping position.

The detailed description provided below together with the accompanying drawings will afford a further understanding of the present invention. Specific embodiments of the present invention which are disclosed herein should be regarded as illustrative and not restrictive of the scope of the invention.

DETAILED DESCRIPTION OF PREFERRED EMBODIMENTS

Figure 1:
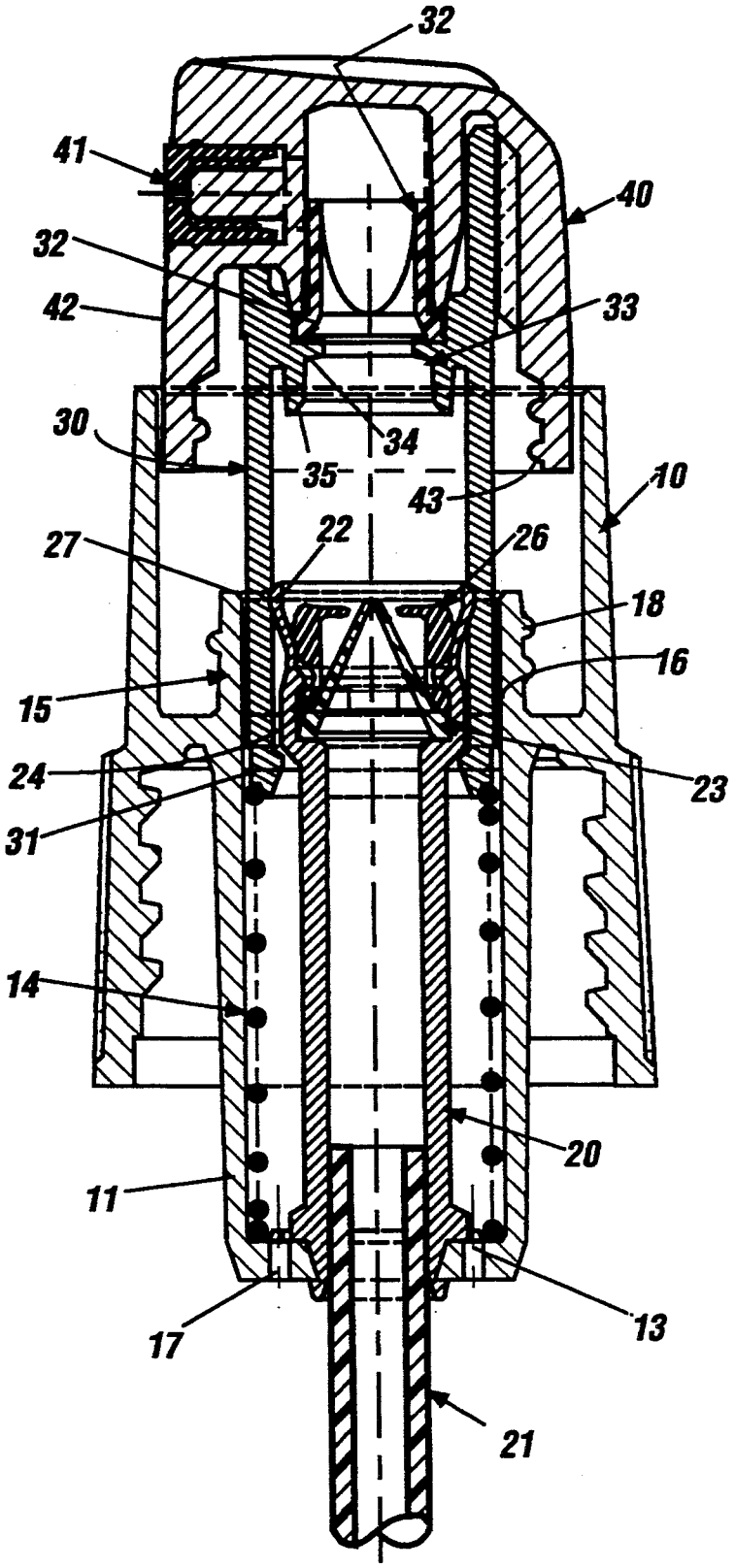
FIG. 1 is a cross-sectional view of a dispensing pump constructed according to the teachings of the present invention, showing the pump plunger in an extended position.
Figure 2:
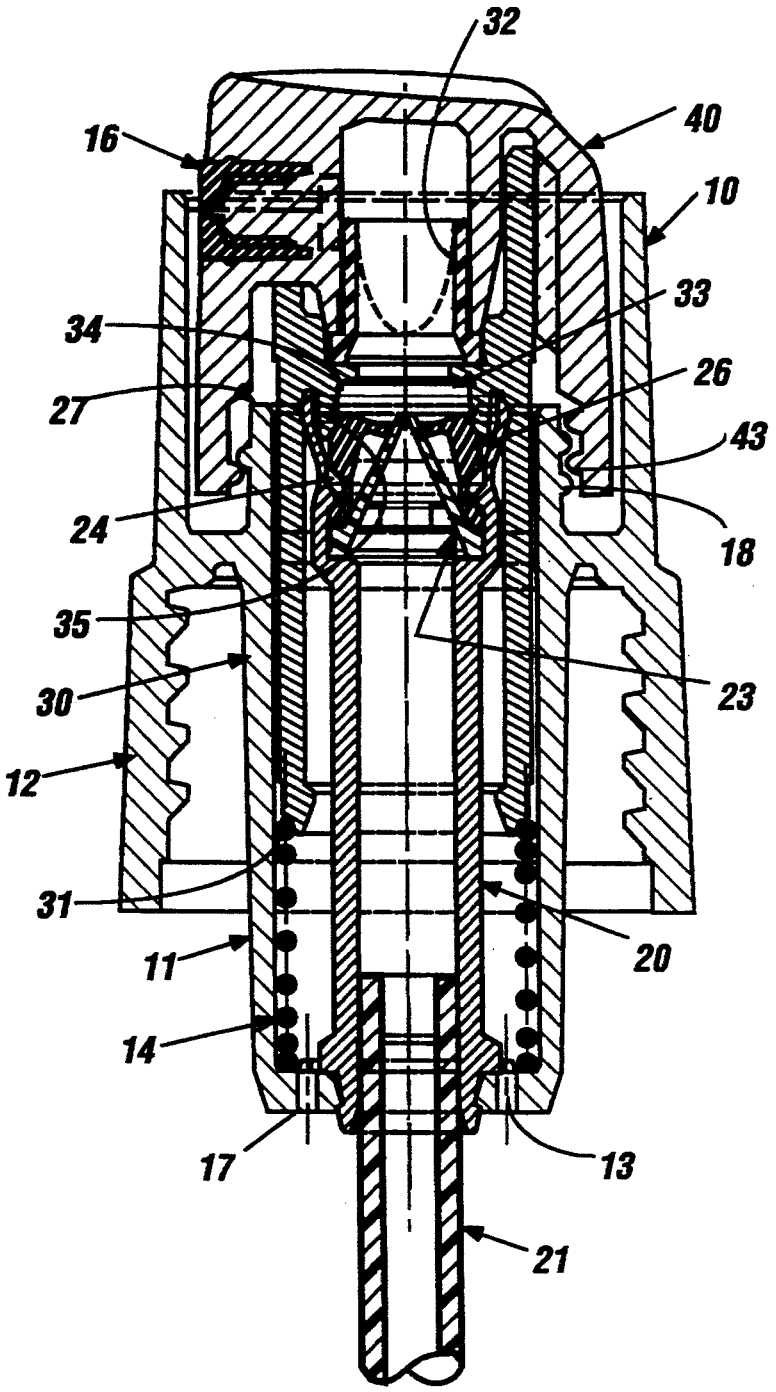
FIG. 2 is a cross-sectional view of the dispensing pump illustrated in FIG. 1, showing the pump plunger in a depressed position.
Figure 3:
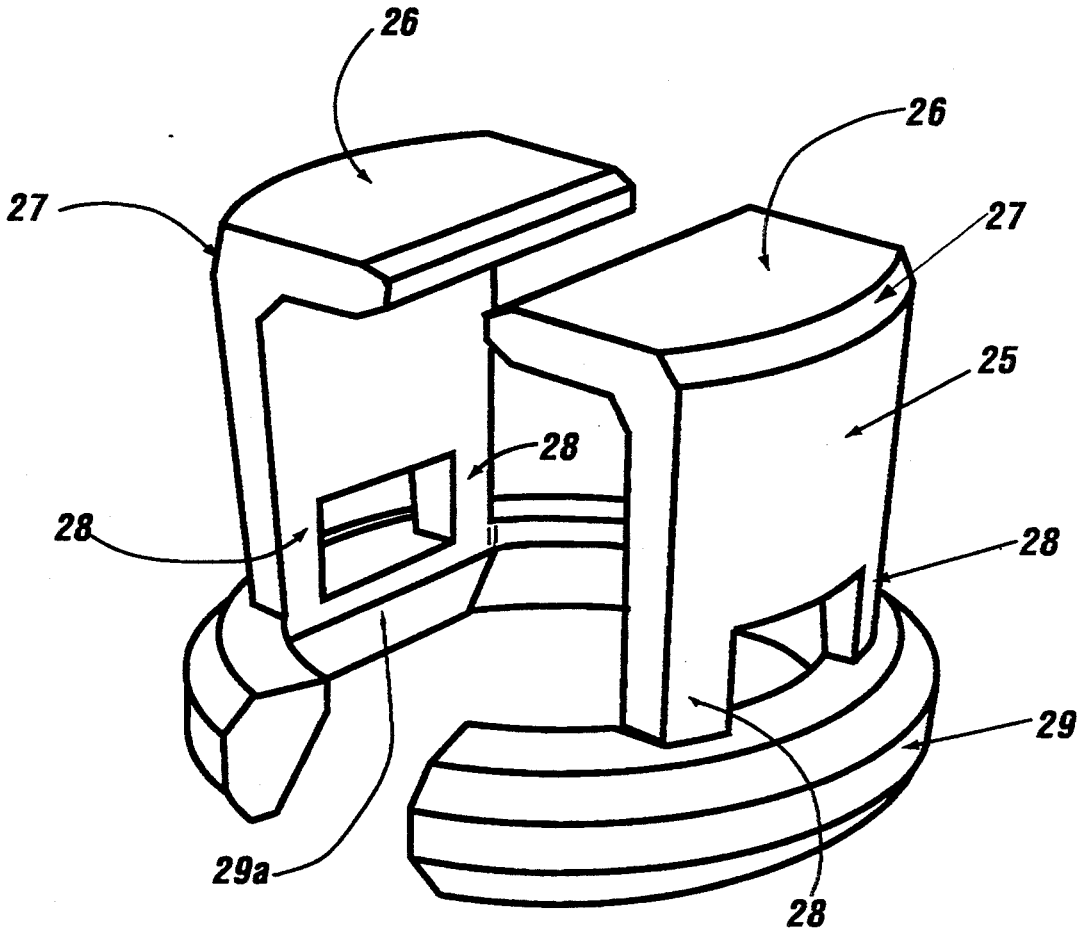
FIG. 3 is an isometric illustration of a valve-closing device employed in the dispensing pump illustrated in FIGS. 1 and 2.

Referring to FIGS. 1, 2, and 3, a dispensing pump incorporating the present invention includes a pump body 10 provided with an internal annular wall 11 forming a well which accommodates stationary and movable pump members 20 and 30 which together form a variable volume pumping chamber. An internally threaded skirt 12, formed integrally with the pump body, provides a means for attachment of the dispensing pump to the threaded neck of a container (not shown) of liquid to be dispensed.

The stationary pump member 20, a tubular piston, is fixed at its lower end in an inturned flange 13 formed at the lower end of annular wall 11. A diptube 21 for conducting liquid to the pump chamber is fitted within the lower end of stationary piston 20. At its upper end the piston is enlarged and bell-shaped and terminates in a sealing lip The movable pump member 30, or plunger, fits within annular wall 11 of pump body 10 and surrounds stationary piston 20. The interior wall surface of the plunger engages the lip 22 of the piston, forming therewith a sliding seal. Adjacent the lower end of plunger 30, on the exterior surface thereof, an annular seal 31 is provided, of a size to engage the interior surface of annular wall 11 to form therewith a sliding seal, for a purpose to be subsequently described. At its upper end, the plunger carries a dispensing head 40 fitted with a discharge nozzle 41.

Seated on an internal shoulder within the bell-shaped upper end of the stationary piston 20 is a one-way inlet valve 23. More specifically, valve 23 is a hollow elastomeric one-way valve commonly known as a "duckbill" valve. This valve has a ring-like base and inwardly tapering sidewalls terminating in a tip provided with a normally closed slit passage.

Surrounding the base of the valve and retained by a bead 24 formed on the interior surface of the bell-shaped upper end of the stationary piston 20 is a fitting 25 provided with hinged pinching elements or leaves 26 which can be moved into pinching engagement with the tip of the inlet valve 23 to thereby positively close the slit passage of the valve. (Details of fitting 25 are best shown in the enlarged illustration of FIG. 3.) Leaves 26 are of generally L-shaped cross-section, and each is provided with a camming shoulder 27.

A one-way outlet valve 32, which may be an elastomeric duckbill valve as shown, is supported on a formation 33 provided in the upper end of the plunger 30. A skirt 34 depends from formation 33. The lower free end of skirt 34 is provided with an internal annular bevel 35 adapted to engage the camming shoulders 27 on leaves 26 to pinch the inlet valve 23 closed when the movable pumping element is disposed in its lowermost position.

The plunger is biased upwardly to an extended position, shown in FIG. 1, by a spring 14 seated on the inturned flange 13 at the bottom of annular wall 11 of the pump body 10. In this position, the volume of the pump chamber bounded by the stationary piston and plunger and the one-way inlet and outlet valves is at its maximum. Downward pressure on the dispensing head will shift the cylinder toward the position shown in FIG. 2 in which the volume of the pump chamber is at its minimum. In this position, the annular bevel 35 on the lower end of skirt 34 engages the camming shoulders 27 of pinching elements 26, pressing them inwardly into pinching engagement with the slitted tip of inlet valve 23.

An upstanding collar 15 formed integrally with the pump body has an interior surface which is a continuation of the interior surface of internal annular wall 11. Formed on the interior surface of the collar is a longitudinally extending groove 16 having an open end at the upper edge of the collar 15. Extending through the lower inturned end 13 of annular wall 11 are one or more passages 17. The groove 16 and the passages 17 together establish a venting passage between the surrounding atmosphere and the interior headspace of a container on which the dispensing pump is mounted. The venting passage is open or closed depending on the position of the plunger 30. In the uppermost, extended, position of the plunger, as shown in FIG. 1, the annular seal 31 formed on the lower end of the plunger is positioned above the lower closed end of groove 16 to establish an open condition of the venting passage. In the lowermost, depressed, position of the plunger 30, as shown in FIG. 2, the annular seal 31 is positioned below the lower closed end of groove 16 to close the venting passage. Obviously, the groove 16 could be made longer if desired to maintain the open condition of the venting passage over a greater portion of the travel of the plunger.

An external thread formation 18 provided on the outer surface of collar 15 is adapted to mate with an internal thread formation 43 provided on the lower interior surface of a skirt 42 which is part of the dispensing head 40. Coupling of the thread formations 18, 43, which places the dispensing pump in a shipping position, can be effected at the lowermost, depressed, position of the plunger 30, as shown in FIG. 2. To enable the relative rotation between dispensing head 40 and collar 15 which is necessary to bring about coupling of the thread formations 18, 43, the dispensing head 40 may be rotatably joined to plunger 30 and/or the plunger may be rotatably disposed within pump body 10.

In the embodiment of the invention shown in FIGS. 1 and 2, the hinged pinching elements 26 are part of a fitting seated on a flange formed at the bottom of the duckbill inlet valve 23 and retained by a bead 24 (or projections) formed on the interior surface of the enlarged upper end of the stationary piston 20. As shown in greater detail in FIG. 3, the pinching elements 26 are joined by integral strap hinges 28 to a split-ring base 29. Flat segments 29*a* on the interior surface of the base match the flat tapering sidewalls of the duckbill valve as an aid to orienting the fitting 25 over the valve during assembly. Fitting 25 is preferably molded from a resilient plastic material. The gap in the split-ring base 29 allows yielding of the base as it is inserted past the retaining ring 24 in the enlarged upper end of the stationary piston 20.

Figure 4:
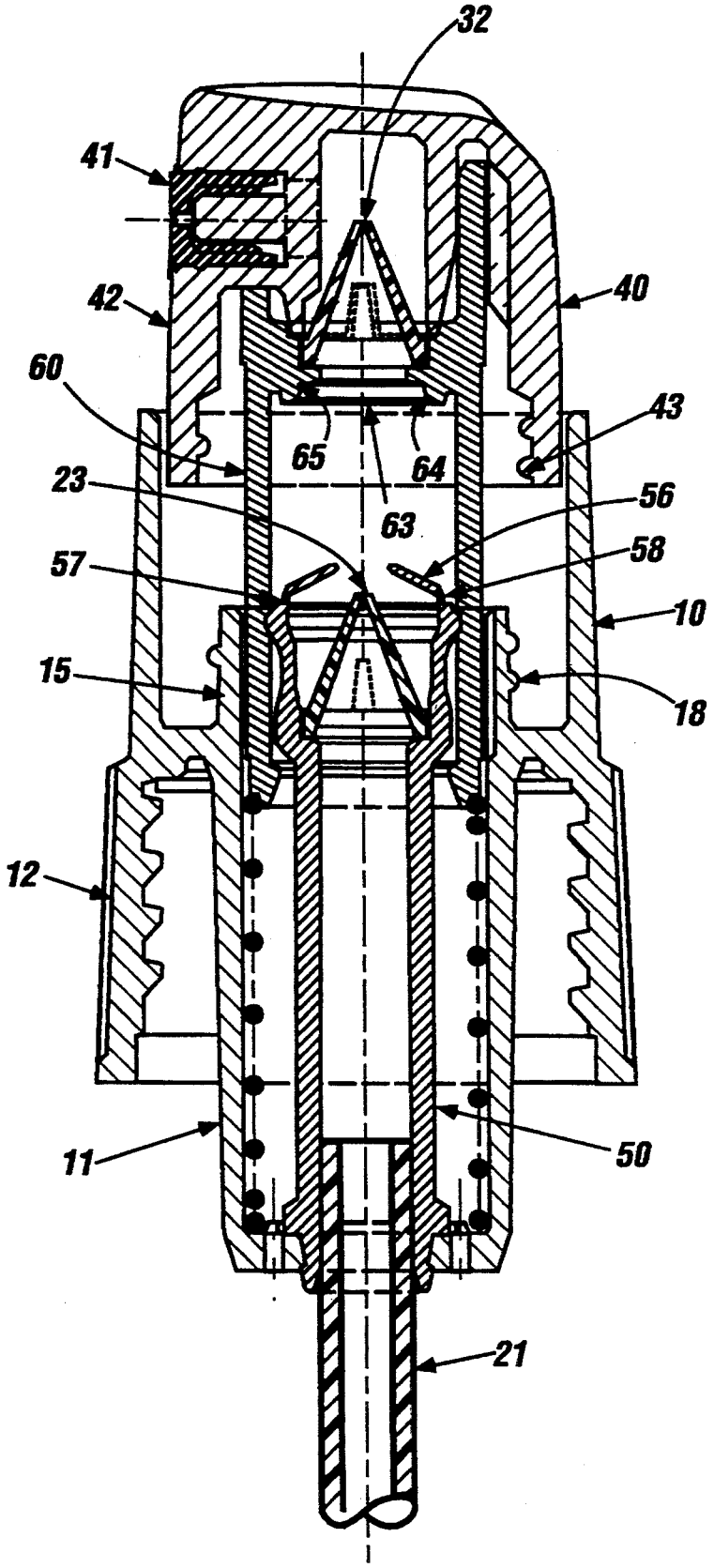
FIG. 4 is a cross-sectional view of another embodiment of a dispensing pump constructed according to the present invention, showing the pump plunger in an extended position.
Figure 5:
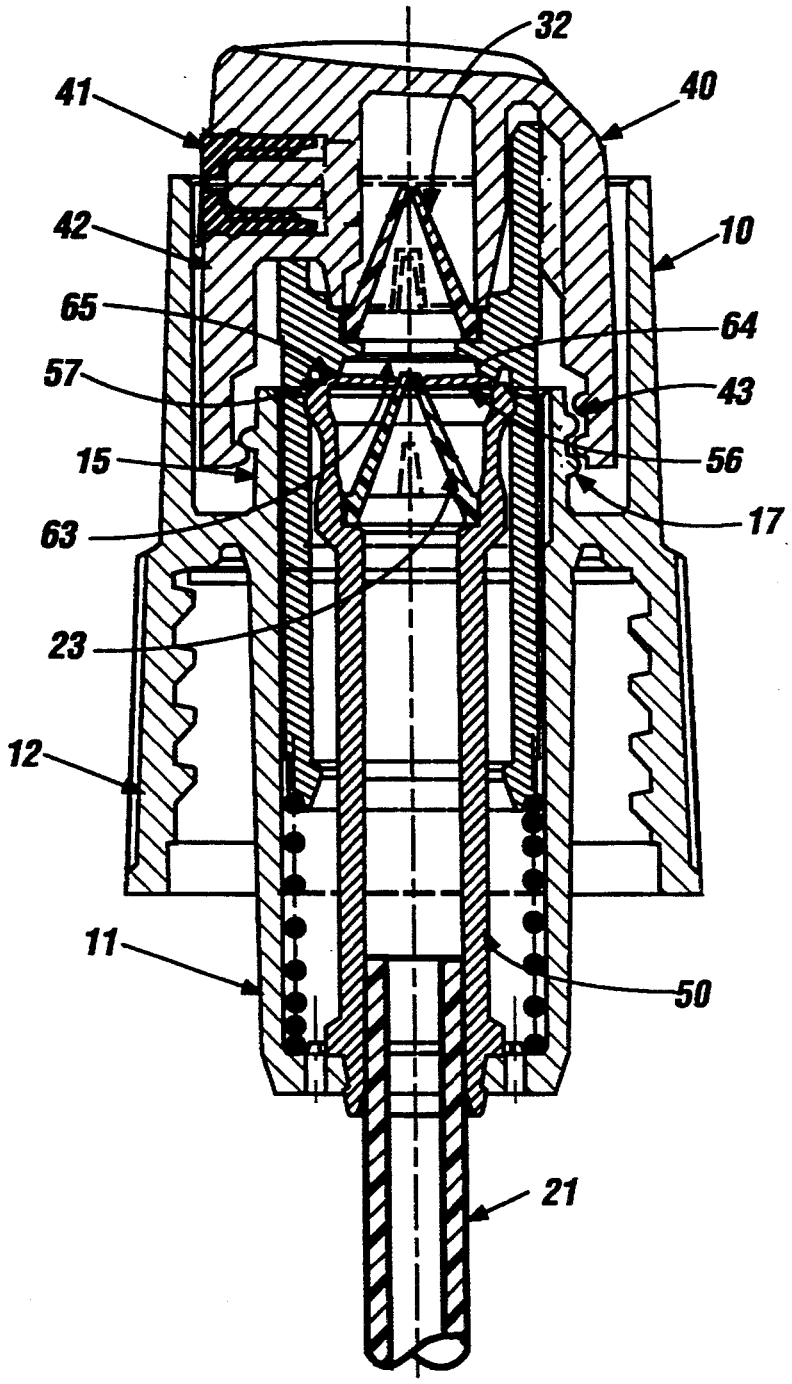
FIG. 5 is a cross-sectional view of the dispensing pump illustrated in FIG. 4, showing the pump plunger in a depressed position.
Figure 6:
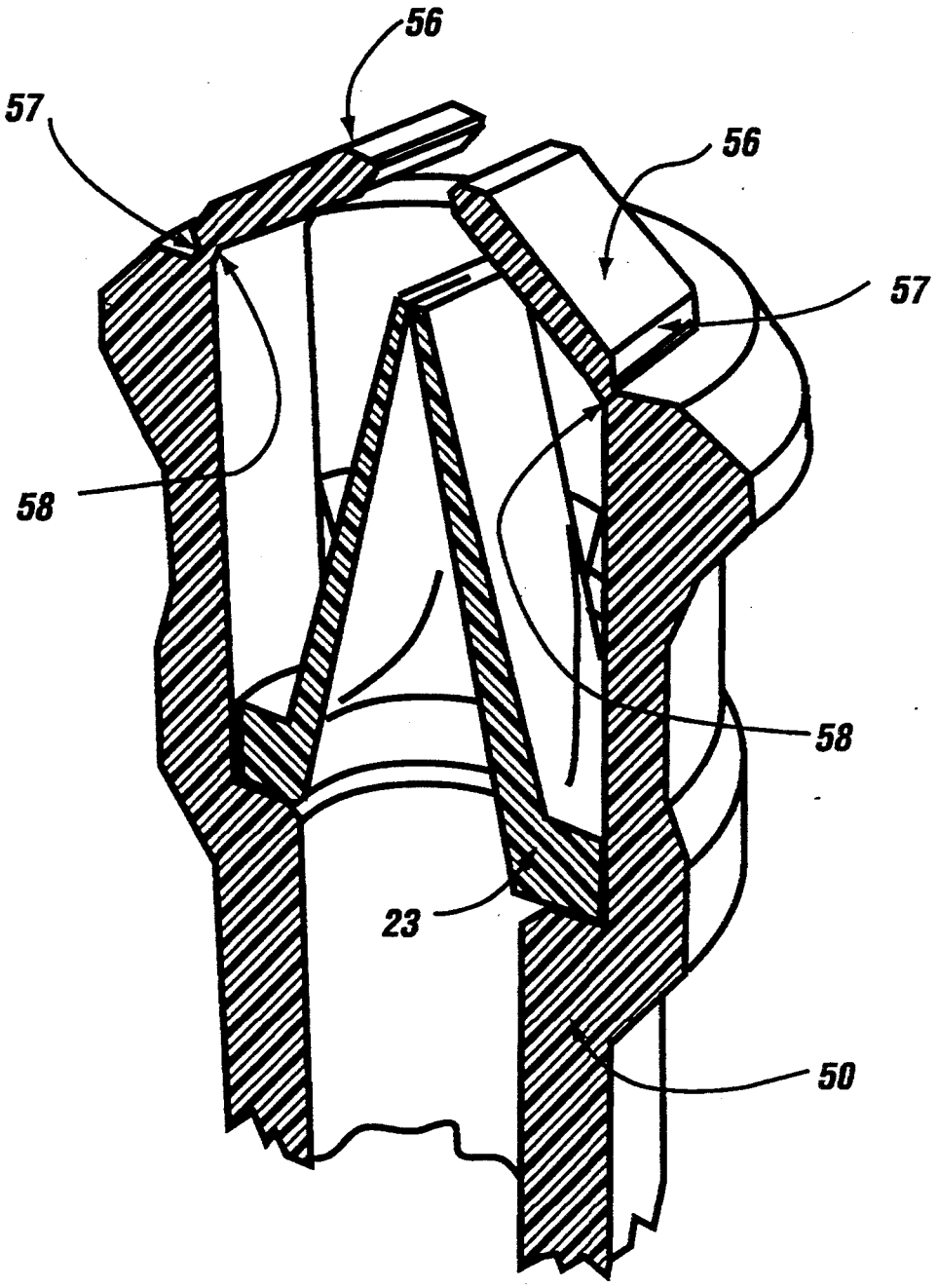
FIG. 6 is an isometric cross-sectional view of the stationary pump member of the dispensing pump illustrated in FIGS. 4 and 5.

Another, presently preferred, dispensing pump constructed according to the present invention is illustrated in FIGS. 4, 5 and 6. Referring particularly to FIG. 6, which shows in cross-section the upper end of modified stationary piston 50, the pinching leaves 56 are generally flat and are joined by integral hinges 58 to the radially inner top edge of the bell-shaped upper end of the stationary piston 50.

As shown in FIGS. 4 and 6, the free inner ends of the leaves 56 are spaced from the tip of the inlet duckbill valve 23 when the plunger 60 is disposed in its upper, extended, position. A bevel 57 is formed on the upper surface of each pinching leaf 56 adjacent its hinge 58. As in the embodiment illustrated in FIGS. 1 and 2, one-way outlet valve 32, which may be an elastomeric duckbill valve as shown, is seated in the upper end of the plunger 60. A skirt 64 depends from the seat 63 for the outlet valve 32. An internal annular bevel 65 formed on the lower free end of the skirt 64 is adapted to engage the bevel 57 formed on each pinching leaf when plunger 60 is disposed in its lowermost, shipping position.

As shown in FIG. 5, the engagement of the bevel 65 of skirt 64 with the bevels 57 on the pinching leaves 56 deflects the leaves downwardly so that the inner free ends of the leaves pinch and close the tip of inlet valve 23. As in the embodiment shown in FIGS. 1 and 2, threads 18, 43, provided respectively on the outer surface of collar 15 and on the lower interior surface of a skirt 42 which is part of the dispensing head 40, may be engaged to secure the plunger in the lowermost shipping position. This embodiment also employs the venting arrangement employed in the embodiment of FIGS. 1 and 2.

Both disclosed embodiments of a dispensing pump constructed according to the teachings of the present invention employ a fixed pump member in the form of a piston and a movable pump member in the form of a plunger fitting about the piston. Without departing from the present invention, this arrangement may be transposed so that the fixed pump member is a cylinder receiving a movable piston, or plunger. In the resulting dispensing pump, a pinching mechanism, similar to the mechanism employed in the embodiment illustrated in FIGS. 1 and 2 may be employed to close the inlet duckbill valve when the plunger is disposed in its lowermost position.

Various modifications of the present invention may be obvious to persons of ordinary skill in the art having the benefit of this disclosure. All such modifications are to be regarded as falling within the scope of the invention as defined in the following claims.

We claim:

1. A dispensing pump comprising:

a pump body provided with means for attachment to a container of a liquid to be dispensed;

a stationary pump member fixedly mounted to said pump body;

a movable pump member slidably mounted to said pump body for movement between an extended position and a depressed position, said movable pump member slidably and sealingly engaging said stationary pump member to form therewith a variable volume pumping chamber having an enlarged volume when said movable pump member is disposed in the extended position and a reduced volume when said movable pump member is disposed in the depressed position;

means forming an inlet passage and an outlet passage both communicating with said pumping chamber;

an elastomeric one-way inlet valve controlling the flow of liquid into said pump chamber through said inlet passage, said inlet valve including resilient confronting lids which normally contact each other to close a slit-like flow passage defined between said lips;

a one-way outlet valve controlling the flow of liquid from said pump chamber through said outlet passage; and means for engaging and applying a closing force to said lips of said inlet valve in response to movement of said movable pump member to the depressed position thereof.

2. A dispensing pump as recited in claim 1, wherein said elastomeric inlet valve comprises a ring-like base and a converging lip formation extending from said ring-like base to a narrow tip, said resilient confronting lips and said slit-like flow passage being defined within said narrow tip.

3. A dispensing pump as recited in claim 2, wherein said means for applying a closing force to said inlet valve comprises pinching elements adapted to press against said narrow tip of said inlet valve and thereby exert pressure to close said slit-like flow passage.

4. A dispensing pump as recited in claim 3 wherein, said pinching elements comprise hinged leaves carried on said stationary pump member.

5. A dispensing pump as recited in claim 4 wherein, said pinching elements are integrally formed with said stationary pump member.

6. A dispensing pump as recited in claim 4 wherein, said pinching elements are formed on a separate member disposed about said inlet valve.

7. A dispensing pump as recited in claim 4, further comprising a skirt formed on said movable pump member, said skirt including a surface which engages said pinching elements when said movable pump member is disposed in the depressed position thereof.

8. A dispensing pump as recited in claim 7, wherein, said surface on said skirt is a camming surface, and said pinching elements are formed with camming surfaces which are engaged by said camming surface of said skirt when said movable pump member is disposed in the depressed position thereof.

9. A dispensing pump as recited in claim 1, further comprising securing means for holding said movable pump member in the depressed position thereof.

10. A dispensing pump as recited in claim 9, wherein said securing means comprises interengageable thread formations carried on said pump body and on said movable pump member.

11. A dispensing pump as recited in claim 1, wherein said movable pump member comprises a tubular member surrounding said stationary pump member 156.

12. A dispensing pump as recited in claim 1, wherein said one-way outlet valve is an elastomeric valve.

13. A dispensing pump comprising:

a pump body provided with means for attachment to a container of a liquid to be dispensed;

a stationary pump member fixedly mounted to said pump body;

a movable pump member slidably mounted to said pump body for movement between an extended position and a depressed position, said movable pump member slidably and sealingly engaging said stationary pump member to form therewith a variable volume pumping chamber having an enlarged volume when said movable pump member is disposed in the extended position and a reduced volume when said movable pump member is disposed in the depressed position;

means forming an inlet passage and an outlet passage both communicating with said pumping chamber;

an elastomeric one-way inlet valve controlling the flow of liquid into said pump chamber through said inlet passage, said inlet valve comprising a ring-like base and a converging lip formation extending from said ring-like base to a narrow tip provided with a normally closed slit passage;

a one-way outlet valve controlling the flow of liquid from said pump chamber through said outlet passage; and means for applying a closing force to said inlet valve in response to movement of said movable pump member to the depressed position thereof, said means for applying a closing force to said inlet valve comprising hinged leaves carried on said stationary pump member and adapted to press against said narrow tip of said inlet valve and thereby exert pressure to close said slit passage.

14. A dispensing pump as recited in claim 13, wherein said hinged leaves are integrally formed with said stationary pump member.

15. A dispensing pump as recited in claim 13, wherein said hinged leaves are formed on a separate member disposed about said inlet valve.

16. A dispensing pump as recited in claim 13, further comprising a skirt formed on said movable pump member, said skirt including a surface which engages said hinged leaves when said movable pump member is disposed in the depressed position thereof.

17. A dispensing pump as recited in claim 16, wherein said surface on said skirt is a camming surface, and said hinged leaves are formed with camming surfaces which are engaged by said camming surface of said skirt when said movable pump member is disposed in the depressed position thereof.

18. A dispensing pump as recited in claim 13, further comprising securing means for holding said movable pump member in the depressed position thereof.

19. A dispensing pump as recited in claim 18, wherein said securing means comprises interengageable thread formations carried on said pump body and on said movable pump member.

20. A dispensing pump as recited in claim 13, wherein said movable pump member comprises a tubular member surrounding said stationary pump member.

21. A dispensing pump as recited in claim 13, wherein said one-way outlet valve is an elastomeric valve.

* * * * *